United States Patent [19]

Thompson

[11] 4,324,350

[45] Apr. 13, 1982

[54] ELASTOMERIC APPARATUS FOR PRESSURE DISPENSING OF FLUID

[76] Inventor: Kenneth W. Thompson, Box 1455, Bartlesville, Okla. 74003

[21] Appl. No.: 39,497

[22] Filed: May 16, 1979

Related U.S. Application Data

[63] Continuation-in-part of Ser. No. 898,813, Apr. 24, 1978, abandoned.

[51] Int. Cl.[3] ..... B65D 37/00

[52] U.S. Cl. ..... 222/212; 222/386.5

[58] Field of Search ..... 222/386.5, 211, 212, 222/105, 95, 107, 131, 183, 387; 220/461–462, 404; 150/8; 285/222, 203; 138/30

[56] References Cited

U.S. PATENT DOCUMENTS

| | | | |
|---|---|---|---|
| 2,816,690 | 12/1957 | Lari | 222/215 |
| 3,244,173 | 4/1966 | Berg | 222/95 X |
| 3,437,231 | 4/1969 | Carpenter, Jr. | 220/462 X |
| 3,940,026 | 2/1976 | Kain | 222/215 X |
| 3,961,725 | 6/1976 | Clark | 222/212 X |
| 4,045,860 | 9/1977 | Winckler | 222/386.5 X |
| 4,121,737 | 10/1978 | Kain | 222/212 X |

FOREIGN PATENT DOCUMENTS

| | | | |
|---|---|---|---|
| 788108 | 12/1957 | United Kingdom | 222/95 |

*Primary Examiner*—Charles A. Marmor
*Attorney, Agent, or Firm*—James H. Chafin

[57] ABSTRACT

A unitary, self-contained fluid spray dispenser comprising an elongated tubular expandable unit of elastomeric material of selected diameter and length, attached at its open end to a valve support plate by way of a plastic neck piece carried by the open end of the unit. The expandable unit is filled with fluid to be dispensed through the valve and distended thereby to a selected volume and internal pressure. A housing of various materials may be implemented to carry the dispenser for purposes of convenience, handling and appearance.

16 Claims, 10 Drawing Figures

ELASTOMERIC APPARATUS FOR PRESSURE DISPENSING OF FLUID

CROSS REFERENCE TO RELATED APPLICATION

This application is a continuation-in-part of application Ser. No. 898,813, filed Apr. 24, 1978 for "Apparatus For Pressure Dispensing of Fluid", which has been abandoned.

CROSS REFERENCE TO RELATED PATENT

This invention is related to U.S. Pat. No. 3,940,026, issued Feb. 24, 1976 to Calvin L. Kain and entitled "Container for Pressure Dispensing of Fluid".

BACKGROUND OF THE INVENTION

1. Field of the Invention

This invention lies in the field of fluid dispensing devices. More particularly, it concerns devices for dispensing fluids in which pressurizing gas is not required, and the pressure which drives the fluid through the outlet valve results from the elasticity of a tubular member or sack into which the fluid is inserted under pressure.

2. Description of the Prior Art

Pressurized containers for dispensing fluids have become very popular for handling many types of fluids in large and small sizes. In the prior art, most of the dispensers have utilized a propellant gas for pressurizing the fluid. Considerable difficulty has been experienced in the construction of the units, and in the handling and disposal of units, particularly after most of the fluid has been dispensed. Furthermore, the cost of the propellant gas is a considerable part of the cost of the device and, of course, this is wasted, since it simply serves to drive the fluid through the valve and into a spray.

Furthermore, the chemical nature of the propellant gas that has been found most useful in recent years is now believed to be damaging to the environment. Attempts are being made to design dispensing systems which do not require such propellant gases.

SUMMARY OF THE INVENTION

It is an important object of this invention to provide a self-contained fluid spray dispenser which does not utilize a propellant gas. It is a further object of this invention to provide a fluid spray dispenser in which the driving force that causes the fluid to pass through the valve and form the spray, is the elastic force of an elastomeric sack or unit into which the fluid to dispense is inserted under pressure, thus distending the unit. The stretched unit therefore provides a confining pressure on the fluid and forces it through the valve when the valve is opened.

It is a further object of this invention to provide a type of elastomeric unit for containing and pressurizing the fluid to be dispensed, while utilizing conventionally available valve support means and valves.

It is a still further object of this invention to provide an improved means of attachment of the elastomeric unit to the valve support means.

It is a still further object to provide a type of fluid dispensing means utilizing the elastic force of an elastomeric unit, and to provide means of insertion of a thin film liner into the unit and to seal the liner under the valve support means.

These and other objects are realized and the limitations of the prior art are overcome in this invention by providing an elongated, tubular, expandable, thick-walled, unit of selected diameter and length made of expandable elastomeric material of selected composition. This unit is closed at one end and is sealed to a valve support means and valve. The valve support means and valve may be conventional devices such as are used on present day propellant gas type dispensers.

The elastomeric unit at its open end is attached and sealed to a plastic neck piece which comprises an outer tube and a smaller coaxial inner tube. This inner tube is supported by radial ribs from the outer tube. The elastomeric material fills the annular space between the outer and inner tubes and is locked in place by surrounding the radial ribs. The neck piece has a curved flange which, in conjunction with the curved flange of the valve support plate means can be clamped around the toroidal ring, or a ring-type neck of a can, for example, or other support means. In this embodiment, the elastomeric pressurized unit is sealed to the neck piece and the neck piece is sealed to the valve plate by being clamped around the toroidal surface of the ring or by placing the neck piece around the toroidal ring and then expanding the valve support plate about the lower portion of the toroidal ring to secure both the valve support and the neck piece to the toroidal ring.

Another feature of this invention is a thin walled plastic film bag of selected material, which is inserted into the interior of the unit, and is clamped under the valve support plate means and thereby sealed. The internal film bag is provided in case the fluid which is to be dispensed has a chemical nature which would attach the elastomeric material. The latter is therefor protected by this film from contact with the fluid which is to be pressurized by the unit.

BRIEF DESCRIPTION OF THE DRAWINGS

These and other objects and advantages of this invention and a better understanding of the principals and details of the invention will be evident from the following description, taken in conjunction with the appended drawings, in which.

DESCRIPTION OF THE PREFERRED EMBODIMENT

Figure 1:
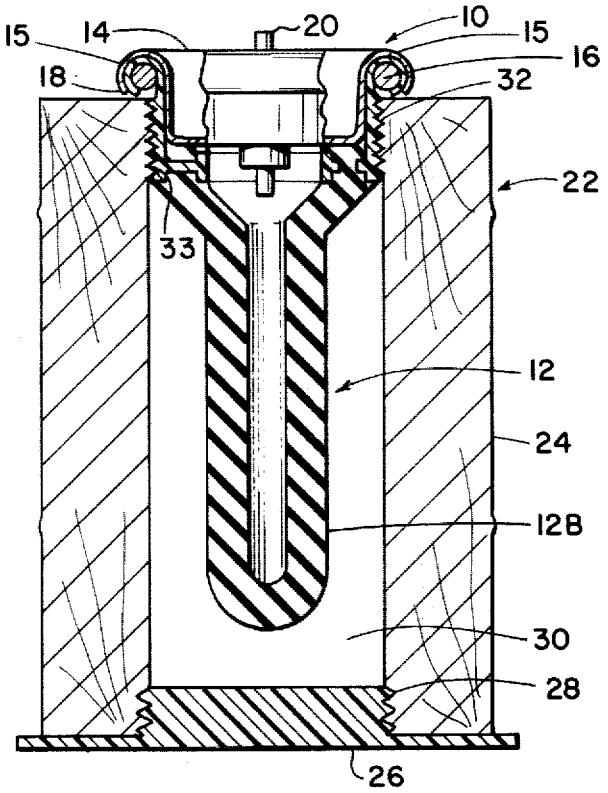
FIG. 1 represents one embodiment of the invention inserted into a housing.

Referring to the drawings and particularly FIGS. 1–6 in detail, for a means for connecting various embodiments of an elastomeric expandable unit generally indicated by reference character 12 and referred to as an elastomeric unit to a conventional valve support plate 14 and in turn to a container, if desirable, as will be hereinafter set forth.

The valve support plate 14 has a curved flange 15 around the outer periphery thereof terminating in an outer annular edge 18 and, in assemblying the unit, the flange 15 is crimped around a toroidal ring 16 so that the outer edge 18 is locked around the ring. The valve support plate 14 is conventional and is available on the market and is used to support a valve 20, which is also conventional, and both are used on dispenser cans which use a propellant gas. In some embodiments the toroidal ring 16 is made as an integral part of a standard container or can be indicated by reference character 66 at FIG. 4.

Figure 2:
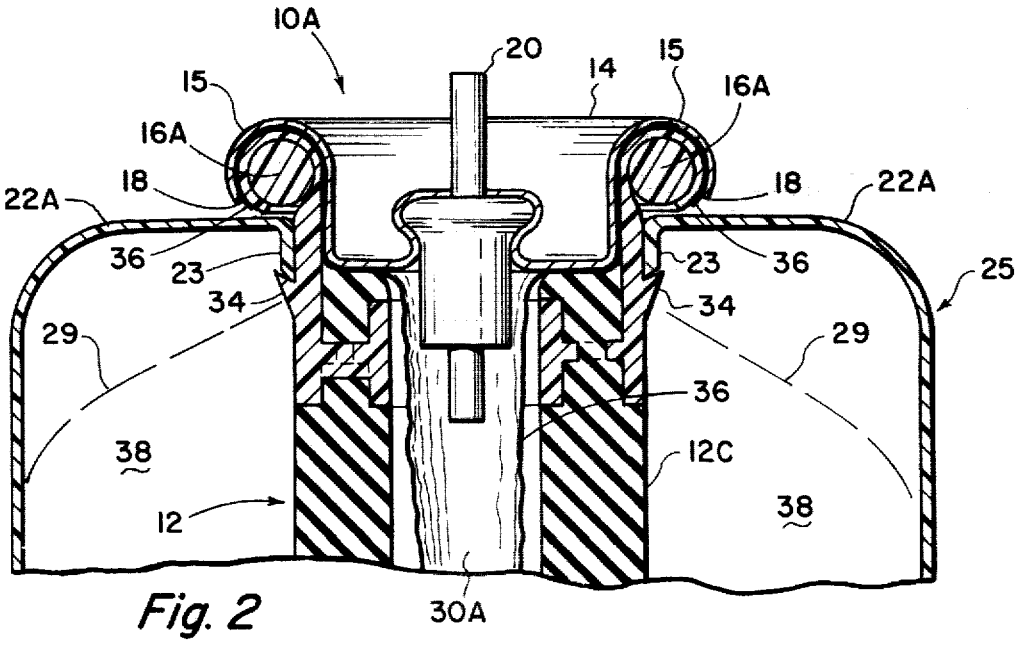
FIGS. 2 and 3 illustrate a second embodiment of the device, including an internal thin film liner.
Figure 3:
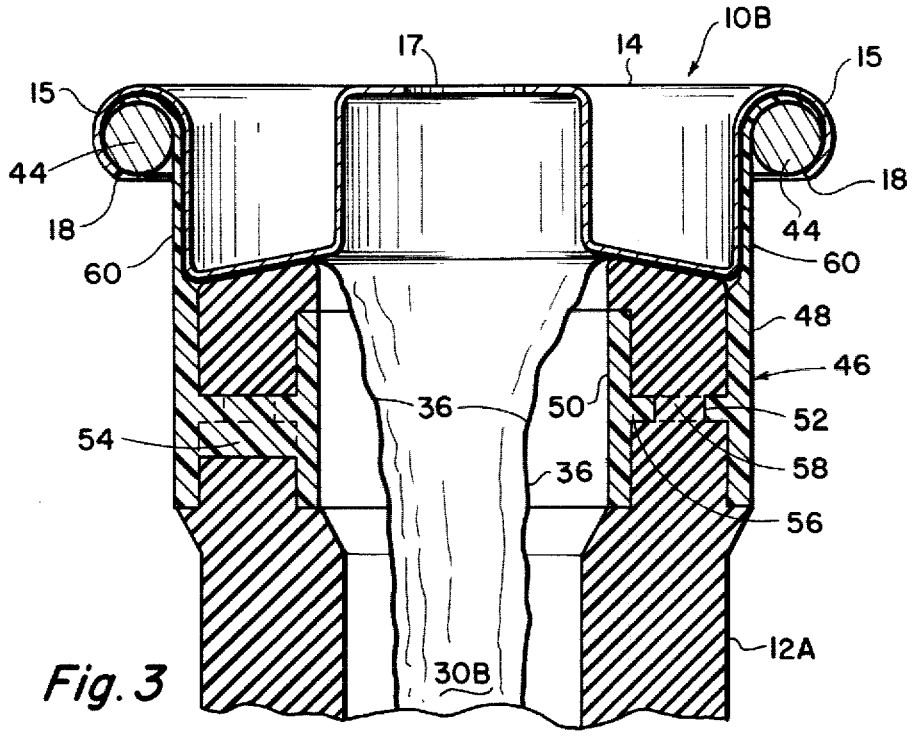

However, in use, the elastomeric unit 12 may be independent of a can or other container as shown in FIG. 3 or may be installed in other forms of containers such as the bamboo or wood variety 22 shown in FIG. 1 or the container 25 shown in FIG. 2 which does not have the toroidal ring made as an integral part thereof.

While the dispensing unit made up of the elastomeric unit 12 and detached valve support means 14 may be freestanding and not require an exterior container, it may be desirable to provide various housings or receptacles as support structures.

In use, the elastomeric unit 12 is distended when filled with the fluid to be dispensed through the valve 20 as will be hereinafter more fully set forth. Further the elastomeric unit 12 may be made of any suitable elastomeric material such as rubber, the product known as Kryton or other suitable expandable elastic material.

Figure 5:
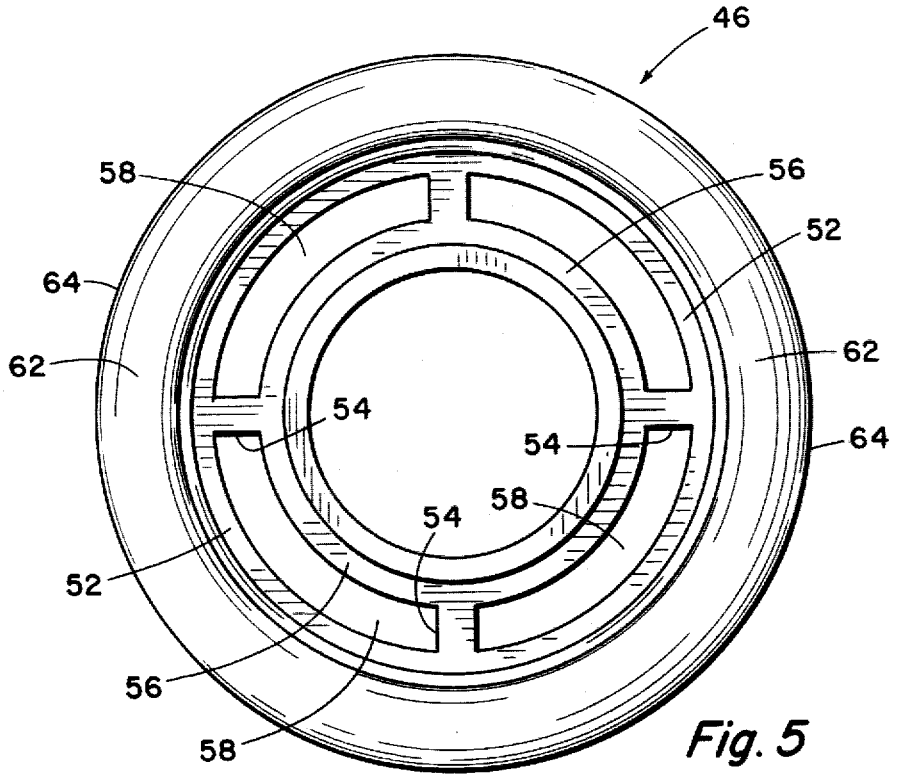
FIGS. 5 and 6 illustrate two views of the plastic neck piece, which is utilized as the support and seal means of the elastomeric unit shown in FIGS. 3 and 4.
Figure 6:
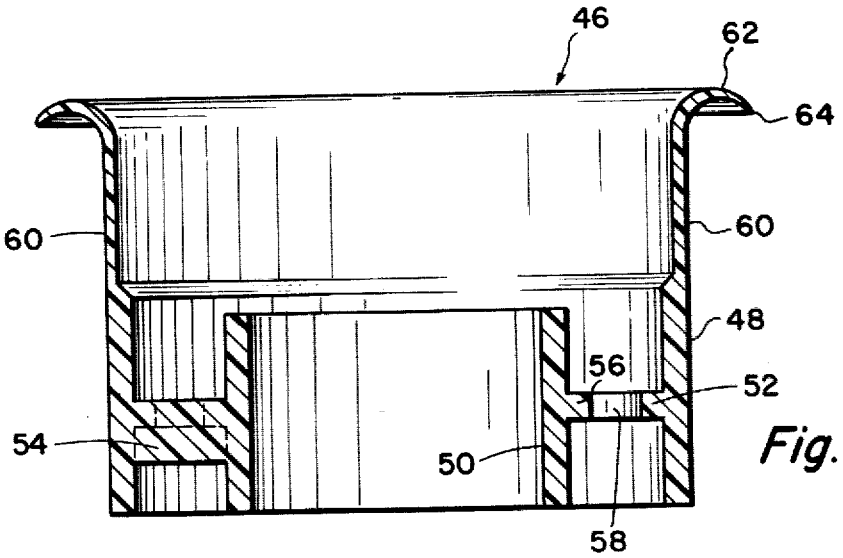
Figure 6A:
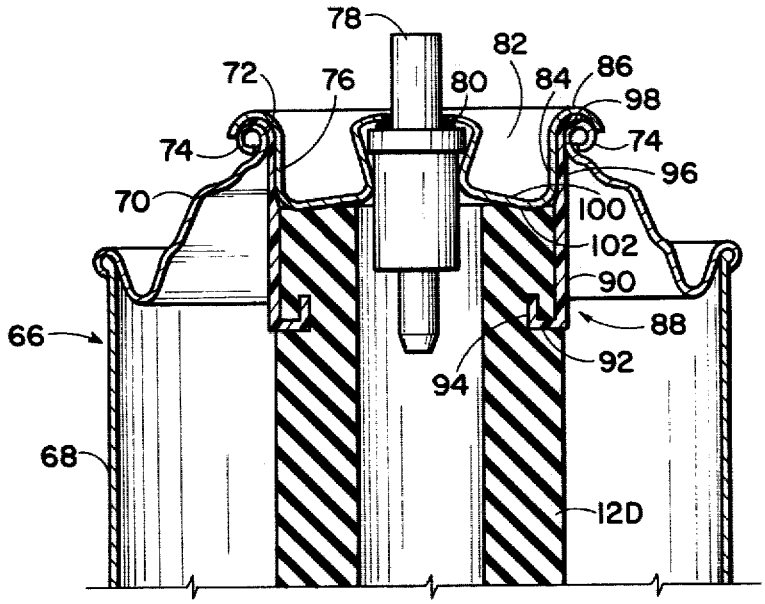
FIG. 6A illustrates a sectional view of a third embodiment of the device inserted in a housing.

Referring first to FIGS. 5 and 6, there is shown in plan and vertical section, a molded plastic device which will be called a neck piece. It comprises an outer cylindrical circular wall 48 which as extended upwardly, thins to a wall portion 60, and then has an outwardly curving flange 62, which thins and terminates in an edge 64. Inside of the coaxial with the outer wall 48 is an inner wall 50. The inner wall is supported by a plurality of spaced radial rams 54 which leave a corresponding plurality of arcuate openings 58 in an annular web which has two annular portions, 52 attached to the outer wall, and 56 attached to the inner wall.

The purpose of this neck piece is to provide a means of supporting and sealing the open end of an elastomeric unit 12. In FIGS. 5 and 6 as will be further explained, the neck piece is sealed to the valve plate and the elastomeric unit is sealed and supported by the neck piece.

Figure 4:
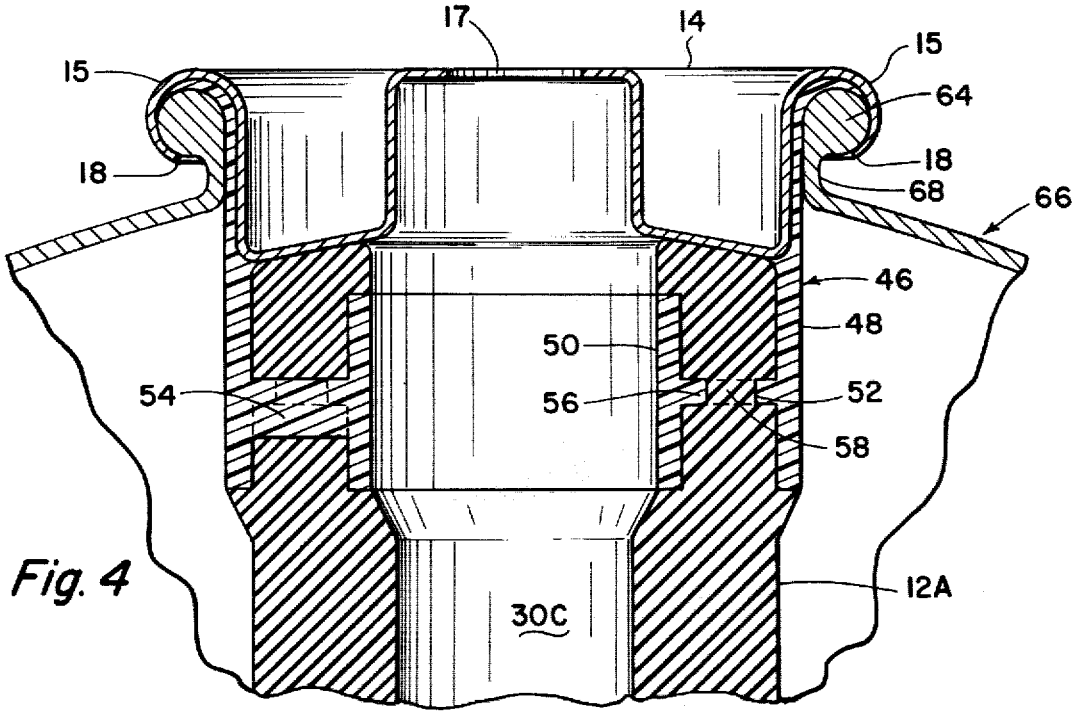
FIG. 4 illustrates a slightly different variation of FIG. 1 inserted into a housing.

How this is done is shown in FIGS. 3 and 4 where the sack indicated by the numeral 12A is molded into the annular space between the inner wall 50 and outer wall 48 of the neck piece, indicated generally by the numeral 46. In addition to the adhesion of the elastomeric material of the unit 12A to the surface of the plastic neck piece, the elastomeric material is further locked to the neck piece by the radial bars and by the short annular flanges 52 and 56. Thus, the combination of the elastomeric unit 12A and the molded plastic neck piece 48 provides a unitary construction which can be locked to and sealed to the valve support plate 14, which holds and is sealed to the valve shown in FIGS. 1 and 2, which is inserted through the opening 17 of the support plate of FIGS. 3 and 4.

Shown in FIG. 3 is another example of an internal thin-walled bag or liner 36 which is inserted into the inner space 30B of the sack and which serves as a liner to prevent contact between the fluid to be dispensed, which is inside the liner 36 with the elastomeric material of the unit 12A. The open end of the liner 36 is laid over the top flange of the neck piece 46, and when the valve support plate is placed over the neck piece and a ring 44 is positioned inside of the flanges, and the edge 18 is wrapped around the ring, the assembly of liner, neck piece, and valve support plate are all locked together and sealed.

FIG. 3 illustrates another method of construction and assembly of a unitary fluid dispensing device, in which the driving force on the fluid is in the internal elastic forces of the elastomeric unit which holds the fluid. FIG. 3 like FIGS. 1 and 2 could be inserted into a separate holder or receptacle.

FIG. 4 illustrates such a separate receptacle 66, which might be a formed metal or cast plastic can having a neck 68 terminating in a ring 64 about which the flanges 15 of the valve plate and 62 of the neck piece can be locked.

Referring now to FIG. 1 of the drawings, there is shown one embodiment of this invention indicated generally by the numeral 10. This comprises an elongated tubular expandable unit 12B of elastomeric material. The unit 12B has molded into itself at the open end, a neck piece similar to the structure of FIGS. 5 and 6 but wherein the outer cylindrical wall of the neck piece is provided with threads 32 for a purpose that will be hereinafter set forth.

When a conventional valve support means 14 is used in conjunction with the elastomeric unit 12B and its threaded neck, a separate toroidal ring 16 is utilized, in much the same manner as the toroidal ring 44 is utilized in the embodiment shown in FIG. 3.

In this particular case, the elastomeric unit 12B is shown with a narrow body portion which may be desirable in using with an oversized valve support 14 or when it is desirable to expel as much product as possible due to an expensive product such as perfume, cologne or the like.

In practice, the unit 10 is self-contained after the flange 15 of the valve support plate 14 has been crimped around the toroidal ring 16 as shown in FIG. 1. The self-contained unit 10 is then threadedly disposed within a suitable housing, receptacle, or support structure indicated generally by reference numeral 22 so that it will remain stable when placed on a surface. The receptacle 22 is made from hollowed bamboo or wood and can be finished in a decorative design, the upper end of the receptacle being provided with threads 33 for receiving the threads 32 of the neck piece.

The dispenser and housing can be made in such a way that when the product from the dispenser 10 is completely used up, the dispenser can be removed from the housing or receptacle 22, such as by the use of cooperating threads 32 and 33. In the case of a bamboo container as shown in FIG. 1, the bottom end thereof may be provided with similar threads 28 and a base cap 26 threadably disposed therein. Hence the container or support structures are reusable.

Referring now to FIG. 2 there is shown a slight modification of the dispenser 10 of FIG. 1. This is indicated generally by the numeral 10A. In this case, the dispenser 10A comprising the elastomeric unit 12C is of slightly different design near its open end. The holder as receptacle, in this case, is inverted plastic or metal cup indicated generally by the numeral 25, and having a suitable opening into which the dispenser 10A is inserted. The wall 22A of the holder has a downwardly depending lip 23, which is adapted to fit into a small lip 34 on the outer surface of the outer cylindrical wall of the neck piece. When the dispenser assembly 10A is completed, that is, when the valve support plate 14 is attached to the ring 16A, by locking the edge 18 around the ring 16A, the assembly 10A is positioned with the unit 12C inserted in the opening in the surface 22A. The lip 34 of the neck piece slides past the edge 23 of the receptacle. When the device is fully inserted as shown, the lip 34 will be locked against the edge of the lip 23, thereby securing the dispenser inside of the holder or receptacle 25.

The bottom portion, though not shown, of the holder or receptacle 25 will be flat bottomed. The space 38 inside of the wall 22A will provide space, as indicated by the dashed line 29, for the outward distention of the wall 12C of the sack. The fluid to be dispensed is inserted under pressure into the space 30A of the elastomeric unit, through the valve 20.

The receptacle shown in FIG. 1 can be made of wood in a decorative manner. In FIG. 2, the receptacle is shown in the form of a metal stamping, or as a cast plastic form. It could also be a pressed paper form that is sufficiently rigid to support the dispenser unit 1 and so on.

It will be clear that when the internal space 30A of the sack is filled with fluid under pressure, there is no pressure in the space 38 inside of the receptacle, so that the receptacle does not have to be sufficiently strong to resist that pressure. If a leak should develop in the wall 12C of the unit, and the fluid should leak out, into the space 38, there still will be no pressure in the space 38 since there is no propellant gas in the fluid inside of the space 38. The driving force against the fluid inside the space 38 that forces it up through the valve and causes the spray, is simply the elastic force or tension in the wall of the unit 12C.

Shown inside of the unit 12C is a thin walled liner 36 which is inserted into the space 30A prior to the attachment of the valve plate to the open end of the elastomeric unit. As shown in the drawing, the bag 36 is folded over the lips of the sack and is locked into position around the ring 16A by the clamping of the flange 15 of the valve plate 14. Thus, there is a complete seal of the open end of the bag 36 which then provides protection of the material of the sack, by keeping it out of contact with the fluid in the space 30A, inside of the bag.

What has been described is an improved type of fluid spray dispenser, in which the driving force of the fluid through the valve and into the spray is derived from the elastic expansion and internal elastic force of an elastomeric unit into which the fluid is inserted under pressure, so as to expand the unit and create a compressive force in the fluid. The form in which the elastomeric unit and its valve support means and valve are tied together creates a self-standing unitary structure which includes all that is needed to provide a reservoir for the fluid to be dispensed. The principal novelty of this invention lies in the self-contained design of the dispenser which is of the simplest type, comprising the elastomeric sack, the closure plate, and the valve.

In order to make it more convenient, a holder, stand, or receptacle can be provided, into which the dispenser can be inserted to make it mechanically stable and convenient to handle and use. The holder or receptacle can be very simple, since it only provides mechanical support and does not provide fluid pressure support for the dispenser. Therefore materials such as plastic, metal, cardboard, wood, etc. can be used, as desired, to make a simple and attractive package.

Also means are shown for the use of a thin-walled bag or liner which can be placed inside of the elastomeric sack, in order to isolate the elastomeric material from chemical contact with the fluid which is to be dispensed. Such a bag or liner would be used wherever there is undesirable chemical action expected between the fluid and the elastomeric material.

There is novelty in the type of mechanical connection and seal provided between the elastomeric sack and the valve plate and valve. In one form, it takes a toroidal ring which is crimped into the lip of the neck piece. The toroidal ring, which may be of metal, plastic or similar material, serves to support the valve plate by means of a flange which surrounds and is locked under the ring or the unit may be crimped around a toroidal ring which is made as a part of a container.

U.S. Pat. No. 3,940,026 has been referred to in this application, since it shows a type of dispenser which uses an elastomeric unit to provide the driving force for a fluid to be dispensed through a valve. This invention differs from that of the patent, by providing novel means for supporting the elastomeric unit and sealing it to the valve support plate, to provide a simple, inexpensive, unitary assembly which can be used in that form, or can be inserted into a housing or receptacle.

It will be clear that in place of the particular shape of plastic neck piece shown, that other shapes can be provided to which the elastomeric material is molded or conversely the neck piece can be made of metal. The essential feature of the invention lies in a substantially rigid neck piece of the general type shown which can be securely attached to, and sealed to, the open end of the elastomeric tubular unit.

While the unit 12 has been shown as a simple cylindrical, thick-walled tube, it is clear that in order to provide for sizable expansion in diameter and/or length, that the material may be cast or molded in a form which might include longitudinal flutes or ribs, or transverse flutes or ribs, and so on, so as to provide for a sizable expansion and small non-stressed internal volume.

Referring now to FIGS. 6A through 9, reference character 66 generally indicates a container typically utilized in aerosol type dispensers. The container generally is closed at the bottom and has sidewalls 68, the top being provided with a dome-shaped cap 70 terminating in a central opening 72 at the top which is surrounded by a toroidal ring member 74.

Sealable in the container opening 72 is a typical valve support plate 76, the center portion of which is provided with an opening for receiving a typical valve member 78 therethrough so that the body of the valve is on the underside of the support plate 76, the valve operator means extending through the central opening of the valve plate. A rubber or similar seal member 80 may be placed between the valve body and the support plate to seal the central opening. There is an annular shaped cavity 82 surrounding the central portion of the valve plate, the valve plate having a substantially vertical sidewall 84, the upper end of which are curled outwardly into a flange portion 86 the underside of said flange portion 86 being capable of receiving the toroidal ring 74 therein.

In this particular volume, the elastomeric pressure unit is indicated by reference character 12D and is constructed similar to the embodiments depicted hereinbefore by reference characters 12A, B and C. However, molded into the upper portion of the elastomeric unit 12D is a neck piece generally indicated by reference character 88 and comprising a cylindrical outer wall portion 90 which surrounds the upper portion of the elastomeric unit 12D. The lower or inner end of the sidewall portion 90 is provided with an inwardly extending flange portion 92 which terminates inside the elastomeric unit with an upwardly extending annular lip member 94.

The upper end of the cylindrical wall portion 90 is provided with a thinner cylindrical portion 96 terminating at the upper end with an outwardly curving flange portion 98.

Again, the elastomeric unit 12D is molded with the plastic neck piece 88 being inserted in the mold so that the unit 12D and neck piece 88 are secured together as an integral part with the inwardly extending flange 92 and lip 94 being embedded in the elastomeric material.

The installation of this particular unit in the typical aerosol type container is as follows: The elastomeric unit 12D and associated neck piece 88 is placed inside the container through the opening 72 so that the outwardly curved flanged end portion 98 partially surrounds the toroidal ring 74. The valve support plate 76 and associated valve member 78 is then placed in the opening over the elastomeric unit 12D and associated neck piece so that the flanged portion of the neck piece 98 is sandwiched between the toroidal ring 74 and the flange lip portion 86 of the valve support plate. The position of the neck piece 88 and the elastomeric unit 12D is such that an upper annular end 100 of the elastomeric unit 12D is nested tightly against the lower annular surface 102 of the valve plate 76, all as shown in FIG. 6.

Figure 7:
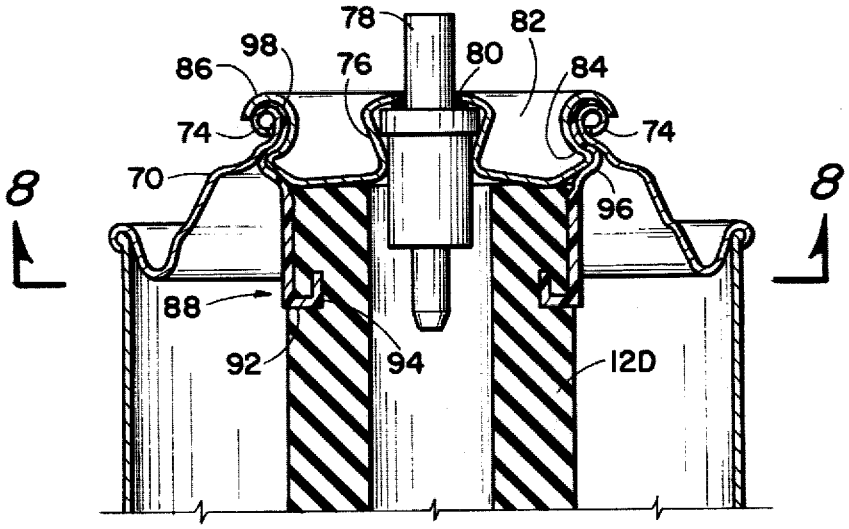
FIG. 7 is the device of FIG. 6 after having been secured to the housing.
Figure 8:
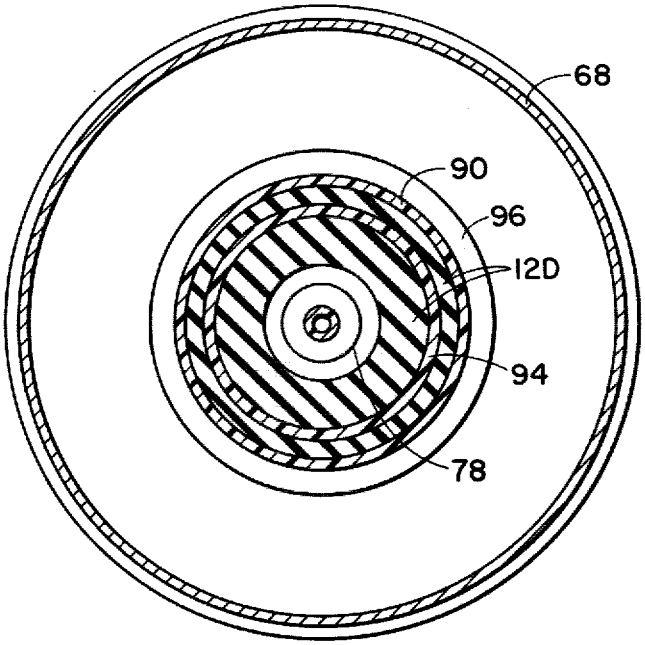
FIG. 8 is an end sectional view of the device of FIG. 7 taken along the broken line 8—8 of FIG. 7.
Figure 9:
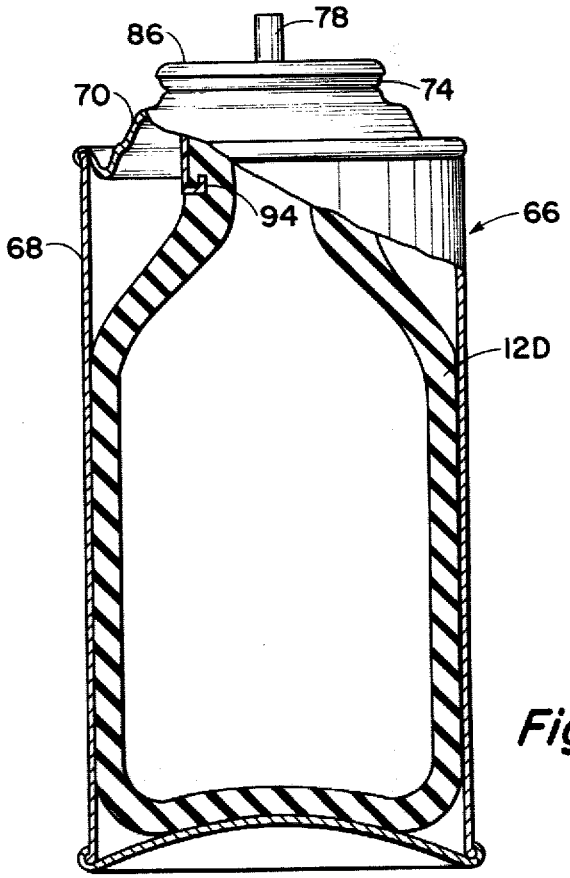
FIG. 9 is a partial sectional view of the device wherein the elastic material is in a distended configuration.

In order to secure the elastomeric unit and valve assembly to the container, an expander tool, (not shown), is inserted into the cavity 82 provided in the valve support plate and the outer cylindrical wall 84 is expanded outwardly as shown in FIG. 7 which in effect curves the wall 84 of the support plate and the wall portion 96 of the neck piece around the lower portion of the toroidal ring 74 which firmly secures the unit together.

A fluid product may then be forced in the container through the valve member thereby expanding the elastomeric unit 12D so that it substantially conforms to the inside shape of the container 66.

As in the embodiments hereinbefore described, to utilize the product, the valve 78 may be operated in a typical manner and the elastomeric property of the unit 12B will then expel the product under the compressive force provided by the elastomeric material.

It is noted at this point that other embodiments such as that of FIG. 3 may be secured to the toroidal ring 44 in the same manner by expanding the walls of the valve support plate around the lower portion of the ring instead of crimping the entire unit over the top of the ring.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. A unitary, self-contained fluid spray dispenser comprising (a) an elongated tubular expandable unit of selected diameter and length made of expandable elastomeric material of selected composition, a separate substantially rigid tubular neck means molded to an open end of the tubular expandable unit said neck means comprising a thin-walled curved flange at the outer end thereof, and at least one portion of said neck means terminating inside the elastomeric material of the tubular expandable unit;

(b) circular valve support plate means attached to and sealed across the open end of said unit;

(c) spray valve means inserted through and sealed to said valve support plate means;

(d) annular toroidal support ring for sealingly securing the valve support plate means to the thin-walled flange portion of the tubular neck means;

whereby said fluid to be sprayed is inserted under selected pressure into the interior of said unit through said valve, thereby expanding said tubular unit, which, because of its enlargement and its elasticity, continues to hold the liquid under pressure until dispensed.

2. The dispenser as in claim 1 including a tubular housing into which said dispenser can be inserted and supported.

3. The dispenser as in claim 1 wherein said thin-walled flange portion of the tubular neck means is clamped between the valve support plate means and the support ring to thereby seal the junction of said valve support plate means and said unit.

4. The dispenser as in claim 3 including a thin-walled tubular film liner closed at one end, and inserted into said unit prior to the attachment of said valve support plate means, the open end of said tubular film liner being clamped between said valve support plate means and said thin walled flanged portion of the neck means.

5. The dispenser as in claim 2 in which said housing comprises a tubular wood assembly.

6. The dispenser as in claim 2 in which said housing is metal.

7. The dispenser as in claim 2 in which said housing is plastic.

8. The dispenser as in claim 4 in which said film liner has a chemical formulation which is immune to reaction with said fluid to be dispensed.

9. The dispenser as in claim 1 wherein the support ring is a toroidal ring and wherein the valve support plate means comprises a second curved flange and whereby the first and second flanged portions are crimped over the toroidal ring.

10. The dispenser as in claim 9 in which said toroidal ring comprises the rolled edge of a can-type housing.

11. A unitary, self-contained fluid spray dispenser comprising an elongated tubular expandable unit of selected diameter and length open at one end and made of an expandable elastomeric material of selected composition;

a substantially rigid tubular neck means comprising a short outer tubular wall having an outwardly extending thin walled curved flange portion at the outer end thereof, an inner tubular wall attached to said outer wall by a plurality of spaced radial ribs attached near the middle of said short wall, the elastomeric unit open end being molded into an annular space between said inner and outer walls, and above and below said ribs;

a circular valve support plate means attached to and sealed across the open end of said unit and comprising a second curved flange portion;

spray valve means inserted through and sealed to said valve support plate means;

an annular toroidal ring for sealingly securing the valve support plate means to the tubular neck means wherein said first and second flange portions are crimped over the toroidal ring;

whereby said fluid to be sprayed is inserted under selected pressure into the interior of said unit through said valve, thereby expanding said tubular unit, which, because of its enlargement and its elasticity, continues to hold the liquid under pressure until dispensed.

12. The dispenser as in claim 11 in which said valve support plate means has an outer diameter which is substantially equal to the inner diameter of said outer wall.

13. The dispenser as in claim 11 in which said toroidal ring is made of metal.

14. The dispenser as in claim 11 in which said toroidal ring is made of plastic.

15. A unitary, self-contained fluid spray dispenser comprising an elongated tubular expandable unit of selected diameter and length open at one end and made of expandable elastomeric material of selected composition;

a substantially rigid tubular neck means comprising an outer tubular wall having an inwardly extending thin walled curved flange portion at an outer end thereof, an inwardly directed flange about the inner end thereof, an annular lip member provided along the inner edge of said inwardly directed flange and extending toward the open end of the expandable unit wherein said elastomeric unit open end is molded in and around said inwardly directing flange and associated lip member whereby said flange and lip member terminate inside the elastomeric material of the tubular expandable unit;

a circular valve support plate means attached to and sealed across the open end of said unit and comprising a second curved flange portion;

spray valve means inserted through and sealed to said valve support plate means;

an annular toroidal ring for sealingly securing the valve support plate means to the tubular neck means wherein said first and second flange portions are crimped over the toroidal ring;

whereby said fluid to be sprayed is inserted under selected pressure into the interior of said unit through said valve, thereby expanding said tubular unit, which, because of its enlargement and its elasticity, continues to hold the liquid under pressure until dispensed.

16. The dispenser as in claim 15 in which said valve support plate means has an outer diameter which is substantially equal to the inner diameter of said outer wall.

* * * * *